United States Patent [19]

Wennerstrom et al.

[11] 4,165,549

[45] Aug. 28, 1979

[54] REACTOR VESSEL CLOSURE STUD CLEANING MACHINE

[75] Inventors: Edward A. Wennerstrom; James S. Brown, Sr., both of Chattanooga; William E. Milligan, Soddy, all of Tenn.

[73] Assignee: Combustion Engineering, Inc., Windsor, Conn.

[21] Appl. No.: 868,237

[22] Filed: Jan. 10, 1978

[51] Int. Cl.[2] ..... A46B 13/02

[52] U.S. Cl. ..... 15/88; 51/105 R

[58] Field of Search ..... 15/21 E, 88, 97 R, 104.04; 51/103 R, 105 R

[56] References Cited

U.S. PATENT DOCUMENTS

| | | | |
|---|---|---|---|
| 2,751,617 | 6/1956 | McLaggan | 15/88 |
| 3,457,576 | 7/1969 | Yarrow | 15/88 X |

*Primary Examiner*—Edward L. Roberts

*Attorney, Agent, or Firm*—Robert L. Olson

[57] ABSTRACT

A stud cleaning machine whereby the threaded portion of very large studs can be cleaned to a semi-bright finish. The cleaning machine is designed to completely enclose the studs during the cleaning operation, so that none of the loosened oxides, residues, and caked lubricants are discharged into the surrounding atmosphere. The contaminated particles are retained in the cleaning machine and removed through an attached vacuum cleaner.

3 Claims, 3 Drawing Figures

REACTOR VESSEL CLOSURE STUD CLEANING MACHINE

BACKGROUND OF THE INVENTION

The head of a nuclear reactor vessel is normally secured to the vessel by means of a plurality of very large bolts or studs. At scheduled intervals, the reactor is shutdown, so that among other things, various pieces of equipment can be cleaned and inspected. The large studs are cleaned and inspected during these periods. These studs can be several feet long and more than 6 inches in diameter, and thus prove cumbersome for hand cleaning. In addition, there is the possibility that the studs may be somewhat radioactive, and thus the personnel can only be exposed to the studs for short periods of time. In addition to the above, in the past the studs had to be removed from the containment building housing the nuclear reactor, to prevent removed oxides, residues, and dried lubricants from contaminating the atmosphere within the containment building.

SUMMARY OF THE INVENTION

In accordance with the invention, a stud cleaning machine is provided which completely encloses the studs, so that none of the loosened contaminants are released to the atmosphere. The drive shaft for causing rotation of the studs during the cleaning operation has a pair of universal joints, so that studs of different diameter can be cleaned in the same machine. Likewise, the rotating wire brushes are mounted on a pivotable arm, and is gravity biased into contact with the stud during cleaning for the same purpose.

DESCRIPTION OF THE PREFERRED EMBODIMENT

Figure 1:
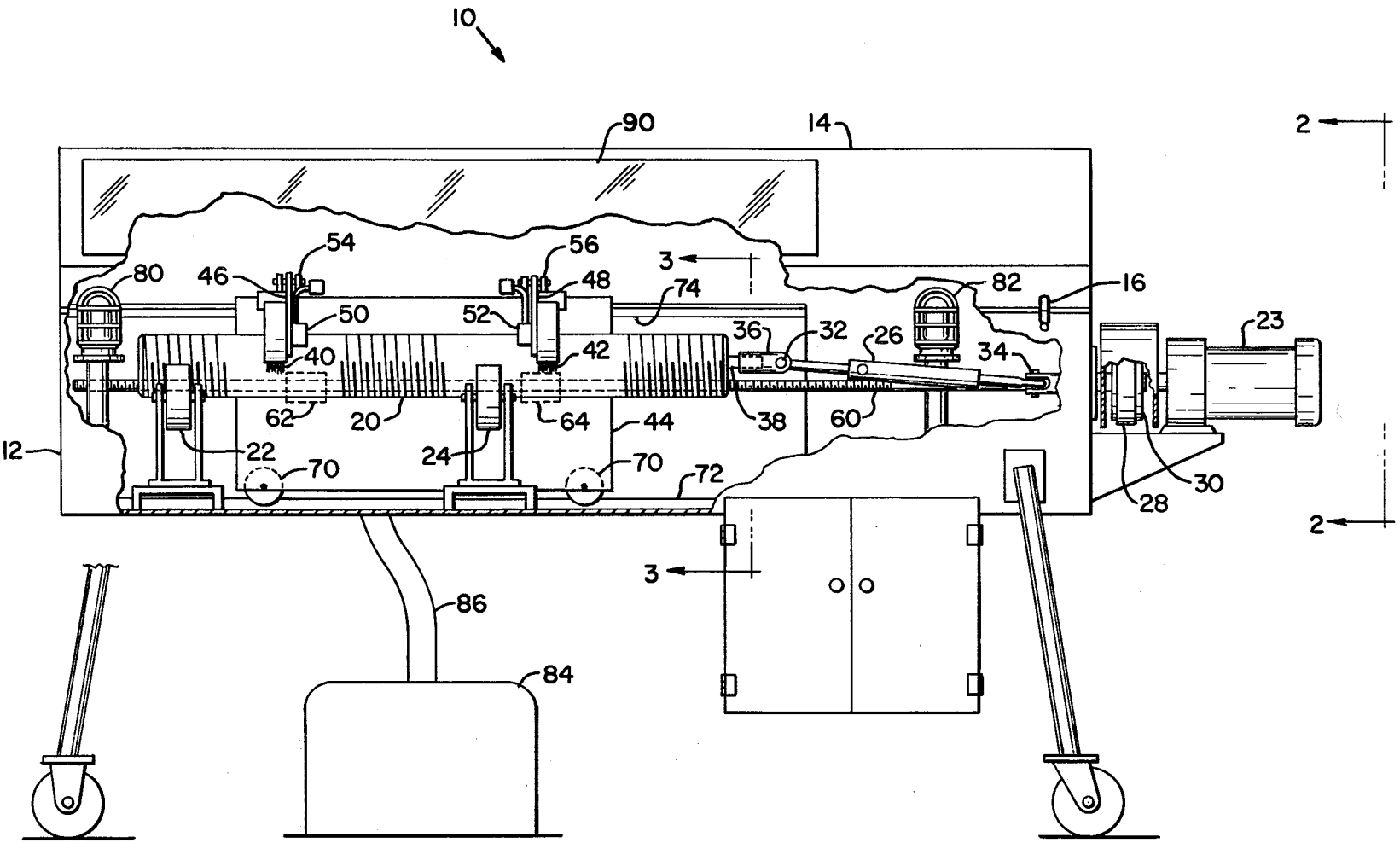
FIG. 1 is a sectional side view of a stud cleaning machine.
Figure 2:
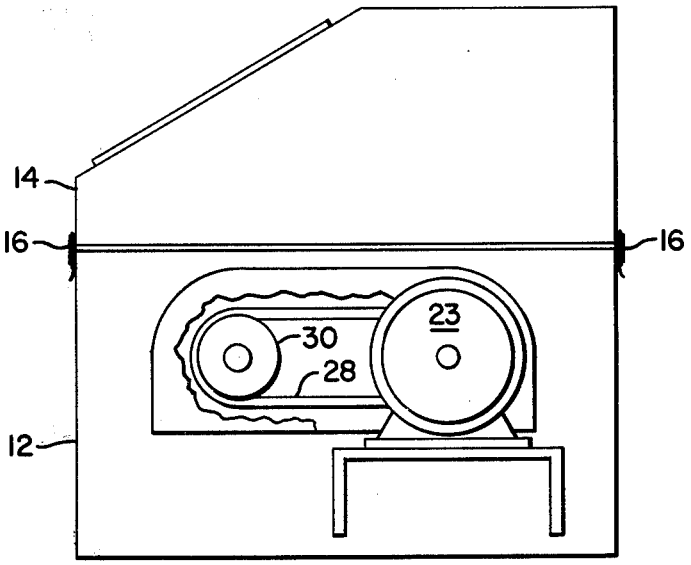
FIG. 2 is a view taken along lines 2—2 of FIG. 1.
Figure 3:
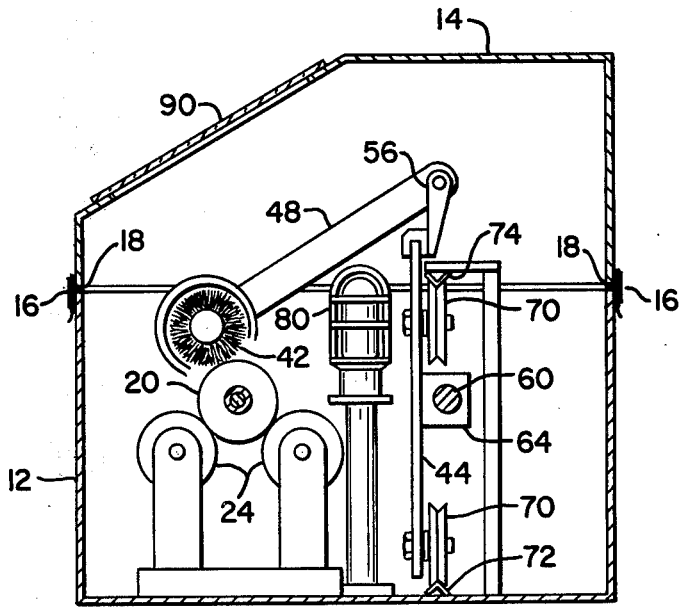
FIG. 3 is a view taken along lines 3—3 of FIG. 1.

Looking now to the drawings, numeral 10 designates the stud cleaning apparatus in its entirety. It consists of a housing 12, having a removable cover 14 which can be latched tightly in place on the housing by means of a latch 16, there being a latch in each of the four corners. A seal 18 (FIG. 3) makes the unit relatively airtight when the cover is on and it is performing a cleaning operation.

A stud 20 is supported in the unit by two sets of roller assemlies, 22 and 24. The stud is rotated during cleaning thereof by means of an electric motor 23 driving shaft 26 through a chain 28 and sprocket 30. The shaft 26 has universal joints 32 and 34 at each of its ends, so that studs of varying diameters can be cleaned in the unit. A female nut assembly 36 is attached to universal joint 32.

This is tightly threaded onto small threaded portion 38 of the stud 20.

The cleaning is accomplished by rotary cleaning brushes 40 and 42, which are attached to the carriage assembly 44 by means of arms 46 and 48, respectively. The brushes are rotated by pneumatic motors 50 and 52. The arms 46 and 48 are pivotably attached at 54 and 56 to the carriage 44, so they are held in contact with the threads of stud 20 during the cleaning thereof by gravity, and can be pivoted up out of the way when a new stud is being placed in the machine.

The carriage assembly is driven back and forth within the housing by threaded drive rod 60, which is engaged with the threaded openings in members 62 and 64 which are integrally attached to the carriage. Carriage 44 has four castors 70, which are attached rotatably in each corner, which castors ride on rails or tracks 72 and 74.

A pair of lights 80 and 82, provide illumination within the housing so an operator can inspect the operation during cleaning through an inspection window 90. A vacuum machine 84 is connected to the inside of housing 12 through hose 86, so as to remove the oxides, dried lubricants and other contaminants from the air inside the housing, which are removed from the studs by the cleaning brushes.

From the above, it can be seen that a stud-cleaning machine is provided in which studs, for example from a nuclear reactor, can be quickly and efficiently cleaned. By using two brushes, with each brush traversing approximately half the threads on a stud, the stud can be quickly cleaned. The stud is rotated at the same speed that the drive rod for the carriage assembly is, so that the brushes ride along in the groove of the threads, and there is little chance of damaging them.

What is claimed is:

1. Apparatus for cleaning threaded studs or bolts including a housing, a removable cover for the housing, a pair of roller assemblies for supporting the stud to be cleaned, drive means for rotating the stud, including a first drive shaft, said first drive shaft having a universal joint at each end thereof, means attached to one of the universal joints which can be attached to the stud, a carriage, means for moving the carriage longitudinally along the length of the stud, a pair of horizontally spaced, rotary brushes mounted on the carriage, the brushes being pivotably mounted on the carriage in such a manner that they can be pivoted away from or into contact with the outer surface of the stud, means for rotating the brushes, and vacuum means attached to the inside of the housing.

2. The apparatus set forth in claim 1, wherein the carriage is driven at a longitudinal speed, and the stud is rotated at a speed, such that the brushes follow the pitch of the threads, thereby minimizing the possibility of damaging the threads.

3. The apparatus set forth in claim 2, including an inspection window contained in the cover, and illuminating means inside of the housing.

* * * * *